United States Patent [19]

Keung et al.

[11] 4,345,447

[45] Aug. 24, 1982

[54] DOUBLE LOCK

[76] Inventors: Poon C. Keung, 28 Chi Kiang St. G/F.; Yiu Fu, 28A Chi Kiang St. G/F., both of Tokwawan, Kowloon, Hong Kong

[21] Appl. No.: 203,403

[22] Filed: Nov. 3, 1980

[51] Int. Cl.[3] ..... E05B 67/22

[52] U.S. Cl. ..... 70/38 A; 292/37

[58] Field of Search ..... 70/38 A, 38 R, 25, 26, 70/39; 292/37, 34

[56] References Cited

U.S. PATENT DOCUMENTS

| | | | |
|---|---|---|---|
| 3,254,516 | 6/1966 | Tornoe | 70/38 A |
| 3,475,930 | 11/1969 | Foote | 70/38 A |
| 3,979,931 | 9/1976 | Man | 70/38 A |
| 4,098,100 | 7/1978 | Wah | 70/38 A |

*Primary Examiner*—Robert L. Wolfe

*Attorney, Agent, or Firm*—Edmond T. Patnaude

[57] ABSTRACT

A laminated padlock includes a J-shaped shackle with a U-shaped locking plate and a T-shaped locking plate, the leg of the T-shaped locking plate being slidably fitted between the spaced legs of the U-shaped locking plate.

7 Claims, 6 Drawing Figures

DOUBLE LOCK

The present invention relates in general to padlocks of the type having double locked shackles, and it relates in particular to a laminated padlock having a new and improved locking slide construction.

BACKGROUND OF THE INVENTION

Padlocks in which a pair of locking members are slidably mounted for reciprocal movement into and out of respective notches in the heel and toe portions of a J-shaped shackle are well known in the art. See, for example, U.S. Pat. Nos. 3,475,930 and 3,979,931. U.S. Pat. No. 4,098,100 describes a laminated padlock having a pair of coplanar slides for double locking the shackle and also having a safety rotator which overlies the inner end of the lock barrel and drivingly connects it to the locking slides. This safety rotor is designed to prevent picking of the lock by means of a tool inserted through the key slot in the lock barrel.

SUMMARY OF THE INVENTION

Briefly, there is provided in accordance with the present invention a new and improved laminated padlock which incorporates a U-shaped locking and an interfitting T-shaped locking slide to provide a smoother operating and more reliable lock. In addition, in one embodiment of the invention a heavy duty safety rotator couples the lock barrel to the locking slides and enables operating thereof by rotating the lock barrel in either the clockwise or counterclockwise direction. In another embodiment of the invention an integral extension on the lock barrel operatively connects to the locking slides.

GENERAL DESCRIPTION OF THE DRAWING

Other aspects of the present invention and a better understanding thereof will be better understood by a reading of the following detailed description taken in connection with the accompanying drawings wherein.

DETAILED DESCRIPTION OF THE INVENTION

Figure 2:
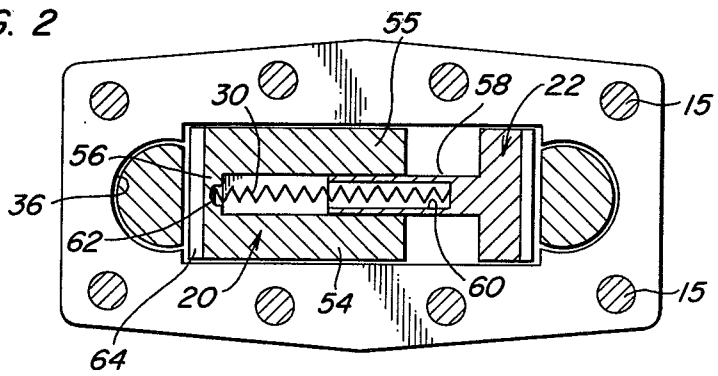
FIG. 2 is a cross-sectional view of the padlock of FIG. 1 taken along the line 2—2 thereof.

Referring to FIGS. 1–4, a padlock 10 comprises a body 12 made up of a plurality of laminated body plates 14, a J-shaped shackle 16, a key-operated lock barrel or cylinder 18, and a locking mechanism including a pair of locking slides 20 and 22 which are operatively connected to the lock barrel 18 by means of a safety rotator 24. The locking slides 20 and 22 are respectively biased outwardly into a pair of notches 26 and 28 in the shackle 16 by means of a single coil spring 30. The shackle 16 has a short leg portion having the notch 28 near the distal end thereof and a longer leg portion having the notch 26 at an intermediate location therein. A coil spring 32 is compressed between the heel end of the shackle 16 and the lowermost end plate 14 of the body 12. An external annular flange 34 at the heel of the longer leg of the shackle 16 prevents complete removal of the shackle 16 from the body 12 inasmuch as the outer diameter of the flange 34 exceeds the inner diameter of the hole 36 through the body plate 14*a*.

The lock barrel 18 is rotatably mounted in a lock body 40 located in a cavity near the bottom of the laminated body 12 and held in place therein by the lowermost body plate 14. The lock body 40 also supports a plurality of tumblers 42 which, as is well known to those skilled in the art, are moved radially outwardly when a key 44 is inserted into the key slot in the lock barrel 18. When the proper key is placed in the key slot the tumbler pins are so positioned as to permit rotation of the lock barrel 18 within the lock body 40.

The lock barrel 18 is provided with an upwardly protruding drive finger 46 which extends into a correspondingly shaped hole in the generally sylindrical body portion 48 of the safety rotator 24. The safety rotator 24 is further provided with an upstanding generally rectangular drive flange 50 which extends diametrically across the circular upper surface of the safety rotator. Rotation of the barrel 18 by means of the key 44 thus results in a corresponding rotation of the safety rotator 24 and the drive flange 50 thereon.

Figure 3:
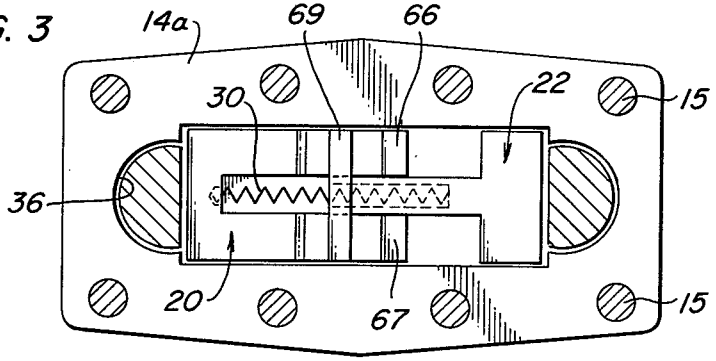
FIG. 3 is a cross-sectional view of the padlock of FIG. 1 taken along the line 3—3 thereof.
Figure 4:
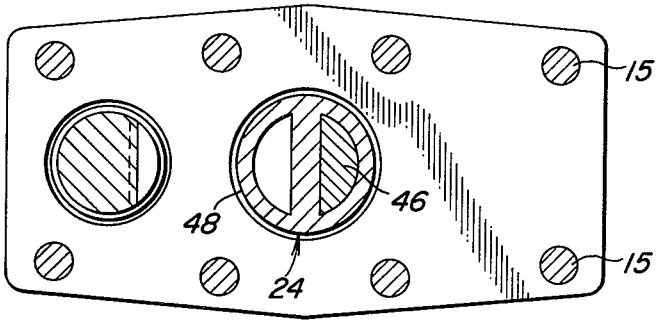
FIG. 4 is a cross-sectional view of the padlock of FIG. 1 taken along the line 4—4 thereof.

The locking slide 20, as best shown in FIGS. 2 and 3, is generally U-shaped and has a pair of parallel leg portions 54 and 55 connected together by the locking slide 22 which is T-shaped and has a central leg 58 which is coplanar with the legs 54, 55 and is slidably disposed therebetween. It may thus be seen that the leg 54 is guided by the legs 54 and 55 to assure smooth and wear-free operation. The leg 58 is provided with an axial blind hole 60 which receives one end of the coil spring 30 and a similar blind hole 62 is provided in the base portion of the slide 20 and receives the other end of the spring 30. A pair of rectangular flanges 66 and 67 depend from the distal end portions of the legs 54 and 55 respectively of the U-shaped locking slide 20, and a rectangular flange 69 depends from the distal end of the leg portion 60 of the locking slide 22. The inner surfaces of the flanges 66, 67, and 79 constitute cam follower surfaces which are engaged by the drive flange 50 of the safety rotator 24 to withdraw the locking ends of the slides from the notches 26 and 27 in response to rotation of the safety rotator 24 in either a clockwise or a counterclockwise direction.

With reference to FIG. 3, it may be seen that rotation of the safety rotator in a clockwise direction will cause the drive flange 50 (not shown in FIG. 3) to engage the inner surface of the flange 66 on the upper leg of the U-shaped slide to move the slide toward the right out of the notch in the shackle 16 and simultaneously to engage the inner surface of the flange 69 at the lower end to move the locking slide 22 inwardly toward the left and out of the respective notch in the shackle 16.

It may thus be seen that the locking slides 20 and 22 are coplanar and are held in the coplanar position by the body plates located directly and below them. They are biased into the locking position by means of a single coil spring 30 and they provide mutually coacting slide surfaces for guiding the slide members for rectilinear motion towards and away from the respective legs of the chackle 16.

Figure 1:
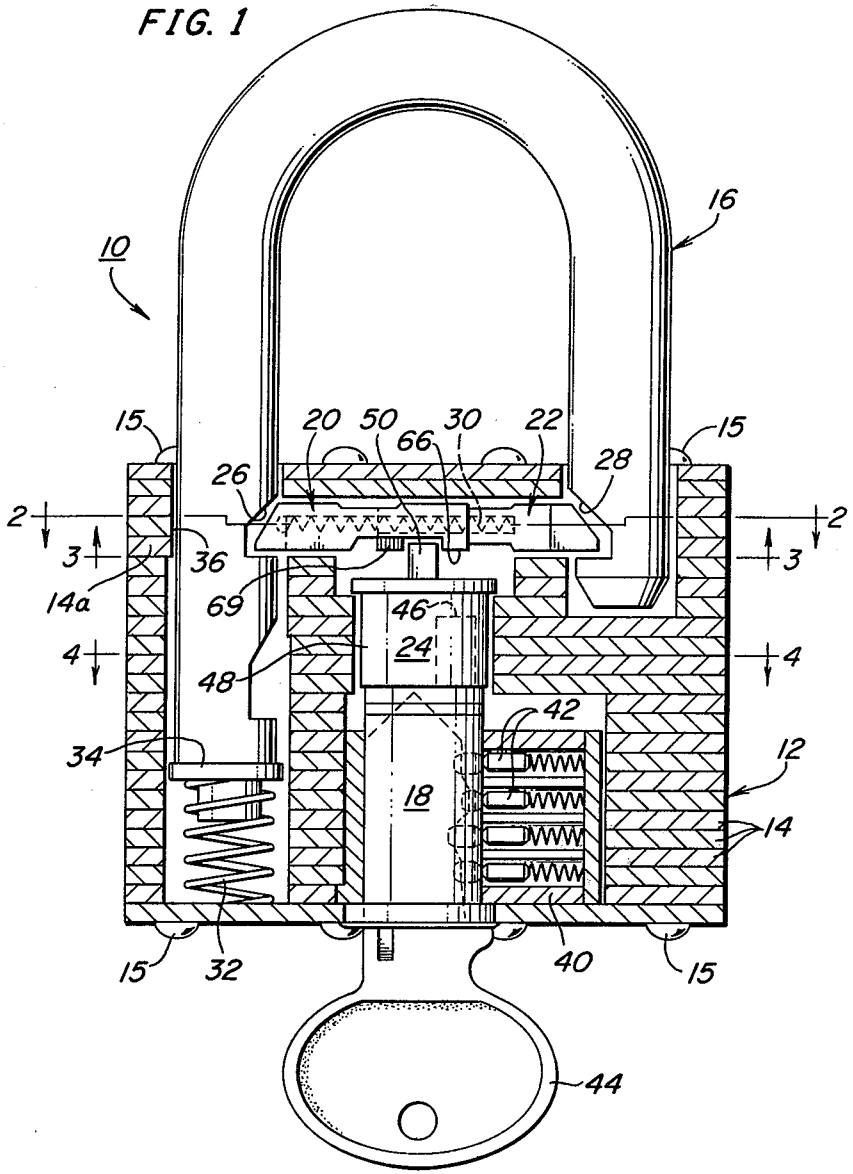
FIG. 1 is a side view, partly in cross-section of a padlock embodying the present invention.

In the embodiment of the invention shown in FIG. 1 the safety rotator 24 has an elongated cylindrical body portion 48 and a relatively short drive flange 50 at the top.

Figure 6:
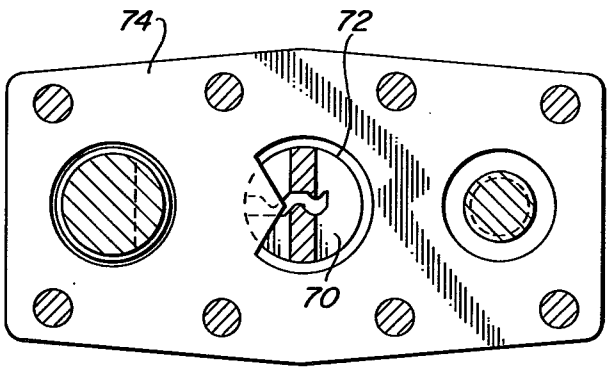
FIG. 6 is a cross-sectional view of the padlock of FIG. 5 taken along the line 6—6 thereof.
Figure 5:
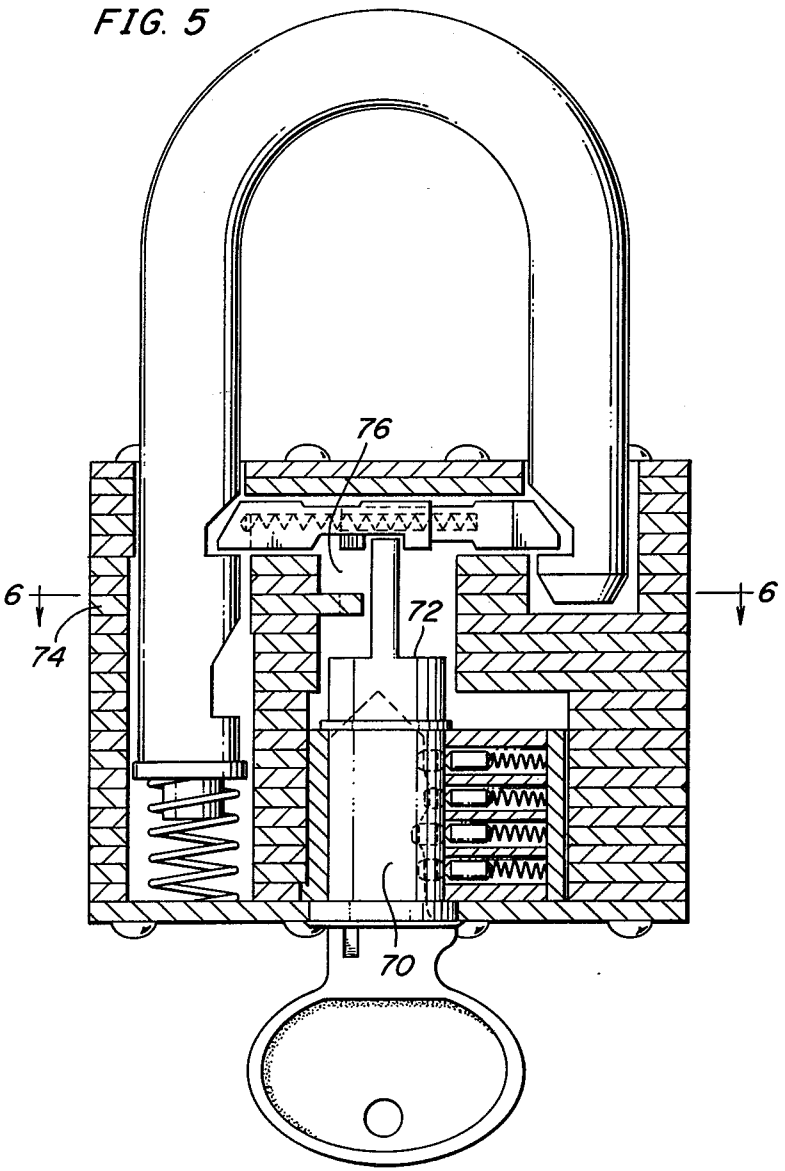
FIG. 5 is a side view, partly in cross-section, of a padlock constituting another embodiment of the invention.

In order to reduce the manufacturing cost of a padlock embodying the present invention, the safety rotator may be eliminated and replaced by an integral extension of the lock barrel itself. Such a padlock is illustrated in FIGS. 5 and 6 and may be seen to include a key-operated lock barrel 70 having an integral rotor 72 extending longitudinally from its inner and between the depending flanges 66 and 69 on the locking slides 20 and 22.

An intermediate body plate 74 extends into the space 76 between the lock barrel 70 and the locking slides to prevent insertion of a picking tool through the key slot into engagement with the locking slides for ectuation thereof. As best seen in FIG. 6, the portion of the body plate 74 which extends into the space 76 is triangular, converging toward the rotor 72 so as not to interfere with the normal turning thereof when the lock barrel is rotated with a key.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A padlock comprising in combination a
plurality of flat plates secured together to provide a laminated body,
a shackle having first and second parallel legs having respective notches therein,
said laminated body having first and second openings respectively receiving said first and second legs,
a key-operated lock barrel mounted in one end of said laminated body for rotation therein,
first and second locking slides mounted on coplanar relationship in said laminated body for reciprocal movement into and out of said notches,
said first, locking slide being U-shaped and having two spaced apart parallel legs,
said second locking slide being T-shaped and having a leg and crossed top portion,
said leg portion of said second locking slide being slidably disposed between said parallel legs of said first locking slide and guided thereby,
a spring compressed between said first and second slides for urging said slides into said notches,
said spring extending into a hole in the distal end of said leg of said second locking slide,
first and second cam follower surfaces respectively provided on said slides and extending toward said lock barrel, and
cam means drivingly connected to said lock barrel and operatively engaging said cam follower surfaces for retracting said slides from said notches in response to the rotation of said lock barrel in said laminated body.

2. A padlock according to claim 1 wherein said cam means comprises
an elongated cylindrical member rotatably mounted in said laminated body,
said cylindrical member having a longitudinal opening therein,
said lock barrel having a longitudinally extending leg extending into said longitudinal opening for drivingly connecting said lock barrel to said cylindrical member.

3. A padlock according to claim 2 wherein
said longitudinal opening and said longitudinally extending leg are semi-circular in cross-section.

4. A padlock according to claim 3 wherein
said elongated cylindrical member is provided with a second semi-circular, longitudinally extending opening complimentary to said longitudinally extending leg.

5. A padlock according to claim 1 comprising
first and second lug portion extending from the distal end portion of said spaced apart legs toward said lock barrel,
a third lug portion extending from the distal end portion of said leg portion of said second locking slide, and
said cam follower surfaces being provided on said lug portion.

6. A padlock according to claim 1 wherein
said cam means is an integral part of said lock barrel.

7. A padlock according to claim 6 comprising
a key slot through said lock barrel opening onto the inner end thereof, and
a portion of said body extending into the space between the inner end of said key slot and said locking slides.

* * * * *